US008416973B2

(12) United States Patent
Medley et al.

(10) Patent No.: US 8,416,973 B2
(45) Date of Patent: Apr. 9, 2013

(54) ELECTROSTATIC LOUDSPEAKERS

(75) Inventors: Andrew Peter Medley, Buckinghamshire (GB); Duncan Robert Billson, Warwickshire (GB)

(73) Assignee: Warwick Audio Technologies Limited, Warwickshire (GB)

( * ) Notice: Subject to any disclaimer, the term of this patent is extended or adjusted under 35 U.S.C. 154(b) by 0 days.

(21) Appl. No.: 12/159,882

(22) PCT Filed: Dec. 19, 2006

(86) PCT No.: PCT/GB2006/050468

§ 371 (c)(1),
(2), (4) Date: Sep. 15, 2008

(87) PCT Pub. No.: WO2007/077438

PCT Pub. Date: Jul. 12, 2007

(65) Prior Publication Data

US 2009/0016552 A1 Jan. 15, 2009

(30) Foreign Application Priority Data

Jan. 3, 2006 (GB) ..... 0600014.5

(51) Int. Cl.
*H04R 25/00* (2006.01)

(52) U.S. Cl. ..... 381/191

(58) Field of Classification Search ..... 381/191
See application file for complete search history.

(56) References Cited

U.S. PATENT DOCUMENTS

| | | | | |
|---|---|---|---|---|
| 3,942,029 | A * | 3/1976 | Kawakami et al. | 307/400 |
| 4,515,997 | A * | 5/1985 | Stinger, Jr. | 381/116 |
| 4,533,794 | A | 8/1985 | Beveridge | |
| 2007/0242843 | A1 * | 10/2007 | Matsuzawa et al. | 381/191 |

FOREIGN PATENT DOCUMENTS

| | | |
|---|---|---|
| DE | 23 30 800 | 1/1975 |
| DE | 103 00 063 | 7/2004 |
| GB | 356 778 | 9/1931 |
| WO | 02/19764 | 3/2002 |

OTHER PUBLICATIONS

International Search Report for corresponding Application No. PCT/GB2006/050468 mailed Mar. 22, 2007.
British Search Report for corresponding Application No. GB0600014.5 dated Feb. 28, 2006.

* cited by examiner

*Primary Examiner* — Charles Garber
*Assistant Examiner* — Calvin Choi
(74) *Attorney, Agent, or Firm* — Renner, Otto, Boisselle & Sklar, LLP

(57) ABSTRACT

An electrostatic loudspeaker comprises a multi-layer panel (1) incorporating an electrically insulating middle layer (2) sandwiched between first and second electrically conducting outer layers (3, 4). A signal generator is provided for applying an alternating electrical voltage across the outer layers (3, 4) to initiate vibration due to variation of the electrostatic forces acting between the layers, thereby serving as a loudspeaker. Furthermore at least one of the outer layers (3, 4) is permeable to air displaced by such vibration. Such a loudspeaker can serve as a low cost audio loudspeaker which can be made lightweight and flexible or large-area so as to render it suitable for a wide range of applications, for example to provide sound reproduction in a home environment without requiring any bulky enclosure, public-address systems, or in a notebook computer or mobile telephone.

17 Claims, 2 Drawing Sheets

ELECTROSTATIC LOUDSPEAKERS

TECHNICAL FIELD

This invention relates to electrostatic loudspeakers.

BACKGROUND

Loudspeakers can generally be grouped into three classes of device, namely electrostatic (coil and magnet), piezoelectric and capacitative. Electromagnetic loudspeakers are used in many applications, such as hi-fi systems, radios, televisions and computers. They generate high quality sound and are cheap to produce and are well established, however they suffer from the fact that they are relatively bulky and heavy, and have limited control over the directionality of the generated sound. Whilst electromagnetic loudspeakers can be made which cover the range of frequency from sub-audio (10 Hz) to the top of the hearing range (20 kHz), it is usual for two or three separate loudspeakers to be used together to span the whole audio frequency range if high fidelity reproduction is required.

Loudspeakers based on piezoelectric principles are currently of considerable interest as they can be used to produce flat loudspeakers which are relatively thin (several mm), and are particularly advantageous where space is at a premium, for example in aircraft or in cars. However such loudspeakers can be relatively expensive to produce and are inflexible, limiting their flexibility of use.

Other Piezoelectric sound sources (with very low sound quality) are produced, and an example of this class of piezoelectric sound source is the "unimorph" used in singing Christmas cards.

Recently, flat panel loudspeakers have appeared on the market, which have a distributed mode source, offering better directionality that has been possible with previous loudspeaker arrangements. These are flat, but still require an excitation mechanism (generally an electromagnetic arrangement, but variants using piezoelectric excitation are possible). There is a maximum size of this class of transducer, meaning that large area sources (desired for some applications) must be made from an array of these devices, limiting the directionality of the source.

Electrostatic loudspeakers are often considered to give the highest quality audio reproduction. Generally such loudspeakers use an electrically conducting thin membrane between two electrode planes. During operation the membrane is electrostatically charged with a high (DC) polarising voltage. If an (AC) audio signal is applied between the two electrode planes a varying electric field will be established which will have the effect of causing the diaphragm to move back and forth at the frequency of this voltage generating sound. However such loudspeakers use very high voltages (1000V and above) and require a bulky enclosure. They also have reduced low-frequency (bass) response.

WO02/19764 discloses an electrostatic audio loudspeaker comprising a multi-layer panel incorporating an electrically insulating middle layer sandwiched between first and second electrically conducting outer layers, at least one of the layers having a profiled surface where it contacts the surface of another of the layers, and signal means for applying an alternating electrical voltage across the first and second layers to initiate vibration due to variation of the electrostatic forces acting between the layers. Such a loudspeaker operates satisfactorily in many applications, but does not provide the best quality sound reproduction, or the loudest output for a given drive voltage.

It is an object of the present invention to provide a novel electrostatic loudspeaker which is capable of better quality and louder sound reproduction than that disclosed in WO02/19764, and which is capable of being used in a variety of applications, and particularly in applications where space or weight is at a premium, or where a large area or directional sound source is desirable.

SUMMARY

According to the present invention there is provided an electrostatic audio loudspeaker comprising a multi-layer panel incorporating an electrically insulating middle layer sandwiched between first and second electrically conducting outer layers, and signal means for applying an alternating electrical voltage across the outer layers to initiate vibration due to variation of the electrostatic forces acting between the outer layers, at least one of the outer layers being permeable to air displaced by such vibration. One (or more) of the outer layers may be manufactured from a porous material, such as a mesh. Furthermore one or more of the layers may be profiled to increase sound output and quality, although this is not always necessary.

Such a loudspeaker can serve as a low cost audio loudspeaker which can be made lightweight and flexible so as to render it suitable for a wide range of applications. For example such a loudspeaker may be in the form of a large area sheet which can be directly mounted on or close to a wall to provide sound reproduction in a home environment without the need for a bulky enclosure, or in a public address system such as may be required in a railway station. Furthermore such a loudspeaker would be particularly suitable for use in applications where space is at a particular premium, for example in a notebook computer or mobile telephone, or integrated into a thin-film flexible display. Since the loudspeaker may also be made transparent or translucent, it would be possible to incorporate it in a computer screen or in a car side window. Because such a loudspeaker can be produced at low cost, it may also be suitable for novelty items, such as noisy posters and talking or singing cards.

The ability to have large (or small) area acoustic sources, operating in a "planar piston" mode, with the capacity to shape the source, and have an easily manufactured array of sources (all of which are possible features of embodiments of the invention) allows a designer of sound systems great control over the directionality of the sound field. For example a large, flat area source may produce a directional beam of sound, which may be desirable in an airport for zoning messages, i.e. only giving sound messages in a particular area, or in a supermarket for advertising a product only in the area in which the product is being displayed.

DETAILED DESCRIPTION

Figure 1:
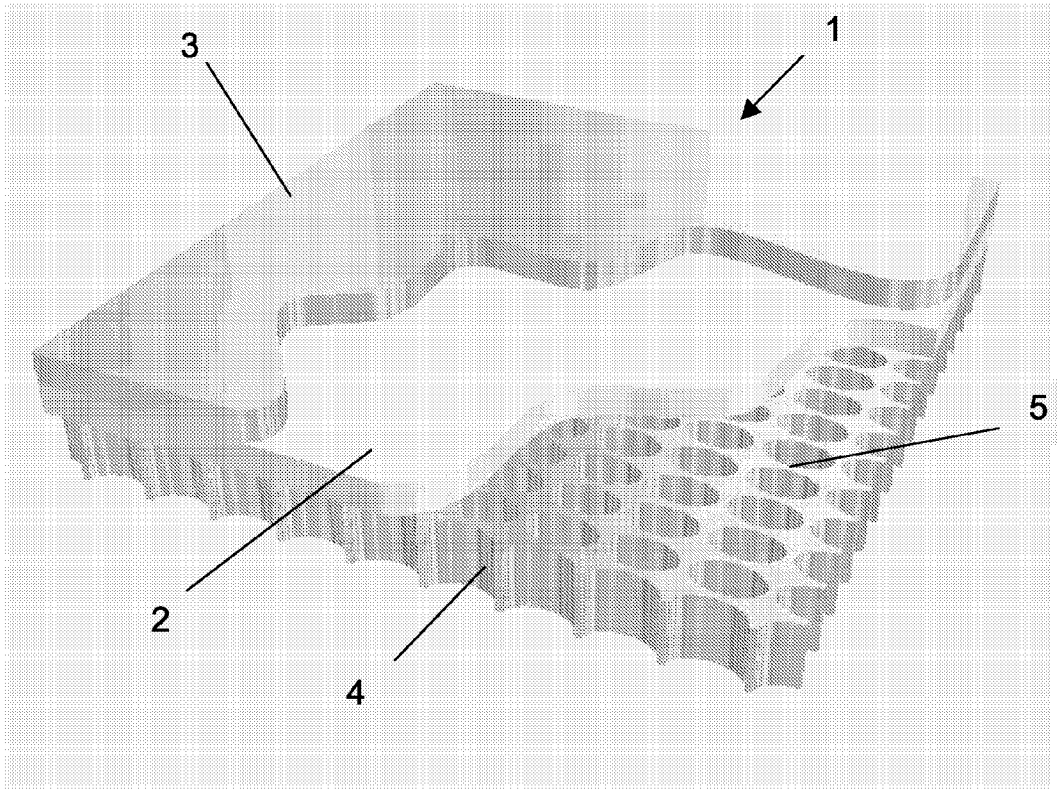
FIG. 1 is a partly cut-away view of part of a preferred embodiment of the invention.

A preferred embodiment of loudspeaker 1 in accordance with the invention will now be described with reference to FIGS. 1 and 2. The loudspeaker 1 comprises a multi-layer panel consisting essentially of three or more layers of thin, flexible material, and more particularly an electrically insulating middle layer 2 sandwiched between top and bottom electrically conducting outer layers 3 and 4. The middle layer 2 is a polymer membrane optionally having a profiled surface having circular pits (not shown) in contact with the top outer layer 3. The top outer layer 3 comprises a thin polymer membrane provided with a layer of metallisation applied to its outer surface by a known metallisation process, such as vapour deposition. Although the top outer layer 3 is shown as a separate layer in FIG. 1, this outer layer 3 may be replaced by a layer of metallisation applied to the back surface of the middle layer 2 by a conventional metallisation process.

The top outer layer 3 may be made from, for example, domestic aluminium foil, metallised foil, paper coated with a layer of conducting paint or copper foil. However, in order to maximise the output from the loudspeaker, a thin polymer membrane provided with a layer of metalisation on its outer surface is preferred. This has a very low mass and is therefore better able to couple its motion to the air generating the sound. In the case of a thin-film display, the display itself can be used as a layer in the loudspeaker.

The middle layer 2 may be made from, for example, paper, greaseproof paper, cloth or plastic. However it would appear that the output is optimised if a polymer membrane is used. Usually this middle layer 2 does not require any kind of profiling in order to optimise the audio reproduction. However profiling of this layer is not excluded. This layer may be permanently electrostatically charged to eliminate or minimise the applied DC bias.

Furthermore at least one of the two electrically-conducting outer layers is porous, that is permeable to air generated by vibration of the loudspeaker. In the illustrated embodiment the bottom outer layer 4 is a thin porous conducting membrane comprising a regular matrix of holes extending through the layer 4. The use of a porous bottom layer 4 helps facilitate the movement of the membranes of the loudspeaker as it ensures the other membranes are not constrained against any forward movement by a pressure imbalance, in the form of a partial vacuum behind the insulating middle layer 2.

The porous bottom layer 4 may, by way of example, be formed from an interwoven mesh of aluminium wire of 0.1 mm diameter comprising parallel strands of wire extending in one direction woven together with strands of wire extending in a perpendicular direction using a twill weave pattern (a twill weave is formed by individual strands going over two strands and then under two strands). The size of the aperture between the wires is typically 0.11 mm and the number of wires used per inch is typically 120. The percentage of open area, governed by the gauge of the wire, is approximately 27%.

From experimentation it has been found that forcing the mesh through a pair of precision rollers, such that the individual wires forming the mesh are flattened across their outer surface (which is referred to as calenderisation) increases the sound pressure level from the loudspeaker.

Figure 2:
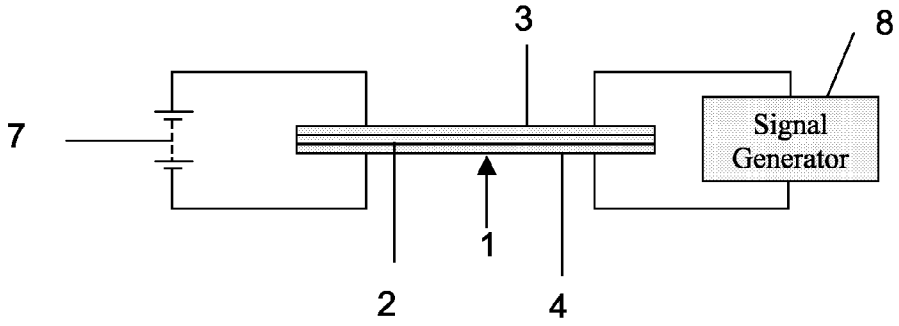
FIG. 2 is a generalised diagram of a drive circuit for use with the preferred embodiment of the invention.

As shown diagrammatically in FIG. 2, a d.c. power supply 7 is provided for supplying a d.c. potential, of, for example, 300V across the top and bottom conducting layers 3 and 4. To vibrate the layers, a signal generator 8 is connected across the top and bottom conducting layers 3 and 4 for applying an alternating signal to drive the loudspeaker 1. Although not shown in FIG. 2, capacitative decoupling may be used to separate the d.c. and a.c. voltages. The d.c. potential causes the top outer layer 3 to be drawn onto the bottom layer 4. When the audio (AC) signal is applied by the signal generator 8 across the outer layers 3 and 4, the electrostatic forces acting between the layers 3 and 2 are caused to vary and this in turn causes the layers to vibrate and the air immediately above it generates the required sound.

The construction of the speaker is also key to the quality of the reproduced sound. When an a.c. signal is applied both conducting layers will vibrate as a rigid piston across the entire area to produce sound. It should be noted that, with a mass difference between the conducting layers, most of the vibration can occur in the top layer. The application of the DC bias causes the top layer to be drawn onto the middle layer which in turn is drawn onto the bottom layer. When an audio signal is applied, the electrostatic forces acting between the layers are caused to vary and this in turn causes the layers to vibrate. As the layers move as a whole in operation, it is important for the layers to be uniform across their surfaces. Any slight deviation caused, for example, by a crease or crinkle will alter the force felt by the layers at that point, thus altering the motion and leading to distortion in the reproduced audio signal.

Such a loudspeaker does not require the large voltages required by conventional electrostatic loudspeakers since the electrostatic field is large because the separation of the electrodes is small. A reasonably small voltage (for example 36V) may therefore be used to produce such an electric field, although higher voltages of 300V may be required in some cases to generate larger acoustic amplitudes.

In a variation of such a loudspeaker the first outer layer 3 may be profiled instead of (or in addition to) the middle layer 2. In a further variation the d.c. supply may be eliminated completely by using a permanently charged material for the membrane and/or the middle layer 2. In a further variation the middle layer is formed by a sheet of a thin porous material, such as paper or tissue. Use of a porous middle layer 2 helps the movement of the top layer in that it is not constrained against movement in the forward direction (i.e. away from the middle layer) by a pressure imbalance, in the form of a partial vacuum behind the layer. This is particularly so for lower acoustic frequencies which require greater displacements, and would generate a greater partial vacuum. For movement in the reverse direction (towards the middle layer) the compressibility of a material such as paper or tissue provides a resilient force which complements or replaces the drumskin tensional forces described previously.

Figure 3:
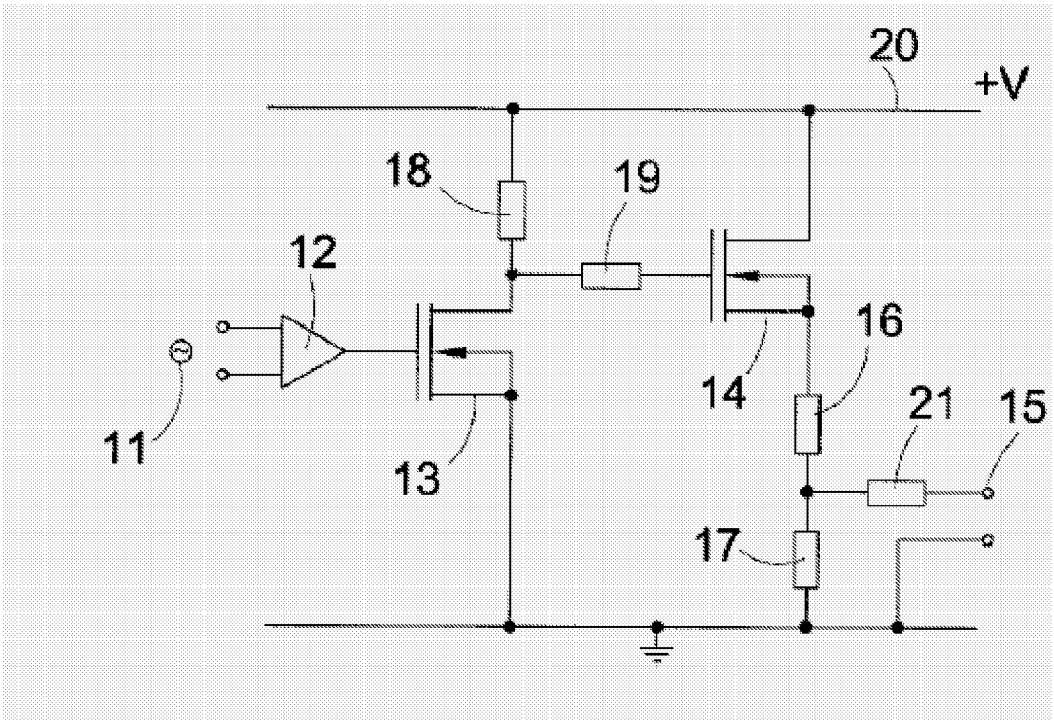
FIG. 3 is a circuit diagram of a drive circuit suitable for use with the preferred embodiment of the invention.

FIG. 3 shows a drive circuit, which may be used to drive such a loudspeaker, having an audio input 10 for receiving an audio input signal to be amplified by a pre-amplifier 12. The signal is then applied to a pair of MOSFET's 13, 14 which are biased by resistors 18, 19 and supplied with power from a voltage supply rail 20, which is typically connected to a +200V supply. The output 15 from this circuit is connected to drive the loudspeakers. By careful choice of resistors 16, 17, 21 the output can be adjusted to have a suitable d.c. bias voltage, as well as an a.c. signal voltage.

Because of the thinness of the layers, the loudspeakers in accordance with the invention described above are not only very thin, i.e. less than 0.5 mm, but are also flexible allowing them to be easily contoured. Such contouring can either be used to fit the loudspeaker to suit its environment, for example to fit within a room with curved walls or within a curved computer casing or screen, or to modify the emitted acoustic field, for example by being made concave to focus the sound or convex to spread the sound. Such a loudspeaker can be adapted very easily to have a frequency bandwidth in air well above the audible range, up to 2 MHz. Whilst such loudspeaker may have poorer low-frequency response, this can be improved by careful design of the loudspeaker components.

The thin profile of such loudspeakers gives them an advantage over more conventional loudspeakers in applications where space is at a premium, for example in notebook computers and mobile telephones. Furthermore, by using transparent polymers and electrodes, it would be possible to produce transparent loudspeaker panels which can be used either in front of computer screens, giving advantages in terms of directionality of sound, or within car windows, both for the purposes of audio reproduction and noise reduction. The low weight of the loudspeakers, together with their thin profile, also offers considerable potential for use in aerospace and other specialist applications, either for audio reproduction or for noise cancellation.

The loudspeakers are inherently efficient at generating sound from electrical signals and can consequently be considered to be low power. This is of particular advantage where power consumption is at a premium, for example with battery powered devices such as notebook computers, novelty Christmas cards, or even novel audio advertising posters. There are advantages in having high electrical efficiency loudspeakers with very-high power public address systems, such as are heard at rock concerts.

The ability to produce large areas of loudspeaker at relatively low cost using such a construction also offers novel applications for home audio systems, allowing loudspeakers to be hung as wallpaper on walls or ceilings. In this regard large area sound sources have potential advantages for the sound field of such audio systems. Furthermore, if a permanently charged polymer film is attached to the rear of the loudspeaker, the resulting electrostatic forces can be used to stick the loudspeaker to the wall, enabling the loudspeaker to be rolled up and moved to a new location when required.

It would also be a relatively straightforward task to enable a single loudspeaker sheet to be separated into separate elements, either by cutting the sheet or by screen-printing rear electrodes in multiple areas. This would provide the ability to produce very high quality surround sound by controlling separate speaker elements to provide the required audio image in a sound stage.

A further application of the invention is to noise cancellation systems in which ambient noise is cancelled by the generation of anti-noise by a loudspeaker component in accordance with the invention.

The invention claimed is:

1. An electrostatic loudspeaker comprising:

a flexible multi-layer panel incorporating an electrically insulating middle layer comprising a first flexible membrane, a first electrically conducting outer layer comprising a second flexible membrane, and a second electrically conducting outer layer comprising a third flexible membrane, wherein the middle layer is sandwiched between the first and second electrically conducting outer layers; and a signal generator for applying an alternating electrical voltage across the first and second electrically conducting outer layers to initiate vibration due to variation of the electrostatic forces acting between the first and second electrically conducting outer layers, the three layers being separately formed so as to be capable of vibrating relative to one another and at least one of the electrically conducting outer layers being permeable to air displaced by such vibration.

2. A loudspeaker according to claim 1, wherein at least one of the outer layers is provided with a regular matrix of holes extending therethrough.

3. A loudspeaker according to claim 1, wherein at least one of the outer layers is in the form of a woven mesh.

4. A loudspeaker according to claim 1, wherein biasing means is provided for applying a steady-state bias potential across the outer layers.

5. A loudspeaker according to claim 4, wherein means are provided for capacitatively decoupling the steady-state bias potential applied by the biasing means from the alternating voltage generated by the signal generator.

6. A loudspeaker according to claim 4, wherein the middle layer and the outer layers are arranged such that the steady-state bias potential across the outer layers causes the first outer layer to be drawn onto the middle layer which in turn is drawn onto the second outer layer.

7. A loudspeaker according to claim 1, wherein the middle layer is made of a polymeric material.

8. A loudspeaker according to claim 1, wherein at least one of the outer layers comprises an electrically conducting film applied to the outer surface of an electrically insulating membrane.

9. A loudspeaker according to claim 8, wherein the electrically insulating membrane is made of a polymeric material.

10. A loudspeaker according to claim 1, wherein the middle layer has a profiled surface in contact with the first outer layer, and the second outer layer is permeable to air displaced by the vibration.

11. A loudspeaker according to claim 10, wherein the middle layer is provided with pits over which the first outer layer extends.

12. A loudspeaker according to claim 1, wherein the multi-layer panel has a thickness of less than 0.5 mm.

13. A loudspeaker according to claim 1, wherein the multi-layer panel is at least partly transparent.

14. A loudspeaker according to claim 1, wherein a plurality of loudspeakers are provided on a single panel.

15. A loudspeaker according to claim 1, wherein the first outer layer and the middle layer are arranged such that the first outer layer and the middle layer vibrate to generate an acoustic sound based on the signal generator.

16. A loudspeaker according to claim 15, wherein the first outer layer and middle layer are further arranged such that the first outer layer vibrates to generate an acoustic sound based on the signal generator.

17. A loudspeaker according to claim 15, wherein the middle layer and the first and second outer layers are arranged to be sandwiched and separately formed so that most of the vibration occurs in the first outer layer when the alternating voltage is applied across the first and second outer layers.

* * * * *